United States Patent [19]

Tamba et al.

[11] Patent Number: 4,681,067

[45] Date of Patent: Jul. 21, 1987

[54] LIQUID-COOLED ENGINE OF THE VERTICAL SHAFT TYPE

[75] Inventors: Shinichi Tamba, Kakogawa; Miyake Hitomi, Kobe; Fukui Noboru, Kakogawa; Akio Miguchi, Kobe, all of Japan

[73] Assignee: Kawasaki Jukogyo Kabushiki Kaisha, Japan

[21] Appl. No.: 872,833

[22] Filed: Jun. 11, 1986

[30] Foreign Application Priority Data

Jun. 12, 1985 [JP] Japan ..... 60-127834
Jun. 13, 1985 [JP] Japan ..... 60-128911

[51] Int. Cl.[4] ..... F01P 3/02
[52] U.S. Cl. ..... 123/41.1; 123/196 W
[58] Field of Search ..... 123/41.02, 41.08, 41.09, 123/41.1, 196 W

[56] References Cited

U.S. PATENT DOCUMENTS 2,968,292 1/1961 Kelly ..... 123/41.08
3,939,807 2/1976 Eichinger ..... 123/41.08
4,493,661 1/1965 Iwai ..... 123/196 W
4,557,235 12/1985 Amemori et al. ..... 123/196 W

FOREIGN PATENT DOCUMENTS 55-73515 5/1980 Japan .
60-49120 3/1985 Japan .

*Primary Examiner*—William A. Cuchlinski, Jr.
*Attorney, Agent, or Firm*—Leydig, Voit & Mayer

[57] ABSTRACT

A liquid-cooled engine of the vertical shaft type has a row of left and right side cylinders arranged in a V-shape as viewed from the above. The cooling water jackets of the left and right side cylinders are connected to each other at the highest ends of the cooling water jackets at the sides of cylinder heads of the cylinders through a communicating passage, a thermostat chamber is provided at the highest end of the cooling water jacket of one of the cylinder heads which is located lower than the other cylinder head, the communicating passage being connected at its one end to the thermostat chamber.

4 Claims, 3 Drawing Figures

LIQUID-COOLED ENGINE OF THE VERTICAL SHAFT TYPE

BACKGROUND OF THE INVENTION

The present invention relates to a liquid-cooled engine of the vertical shaft type provided with water jackets communicating the periphery of each cylinder of the engine with the interior of the respective cylinder head thereof In a prior art engine of the horizontal shaft type, there has been proposed an engine such as disclosed in Japanese Utility Model Laid-Open No. 73515/80. However, difficulties arise when such an engine of the horizontal shaft type is adapted as an engine of the vertical shaft type without changing the construction thereof, in that the thermostat chamber projects upwardly beyond the cylinder so that the total height of the engine becomes too great.

Particularly, in the case where a radiator is arranged in a position above the engine, the radiator must be located at a very high position because of the necessity of providing piping therefor, thereby making the piping and assembling of the radiator very difficult.

The prior art of liquid-cooled engines of the vertical shaft type has been directed to mainly outboard engine applications. Such a prior art engine is shown in FIG. 2 of Japanese Patent Laid-Open No. 49120/85.

In such a prior art engine, an exhaust valve thereof is arranged at an upper position in the engine, while an intake valve is located at a lower position thereof, and, as a result, the following defects occur:

Immediately after the start of the engine, when the termostat valve is closed, the cooling water in the water jacket is generally heated by the convection of the cooling water. However, when a high temperature portion of the engine, such as an exhaust valve, is located at a higher position, a large temperature difference will develop between a higher portion and lower portion of the water jacket delaying the heating of air drawn into the engine.

Further, water can not flow smoothly around the exhaust valve and the exhaust passage which require the largest cooling effect, thereby deteriorating the cooling effectiness.

SUMMARY OF THE INVENTION

An object of the present invention is to permit a liquid-cooled engine of the vertical shaft type to be made compact and the piping arrangement for the cooling water to be facilitated, while positively preventing the trapping of air in the cooling water jacket In order to positively prevent air from being trapped in the cooling water jacket, the liquid-cooled engine of the vertical shaft type according to the present invention is so constructed that a radiator is arranged in an upper position of the engine, while a thermostat chamber is arranged at the upper end of the cooling water jacket. The array of left and right side cylinders is arranged in a V-shape when viewed from the upper side, and the cooling water jackets of each of the left and right side cylinders communicate with each other at the uppermost ends thereof through a communicating passage, a thermostat chamber being formed at the uppermost end of the cooling water jacket of the cylinder head located at the lower side, while one end of the communicating passage is opened to the thermostat chamber.

DETAILED DESCRIPTION OF THE PREFERRED EMBODIMENTS

Figure 1:
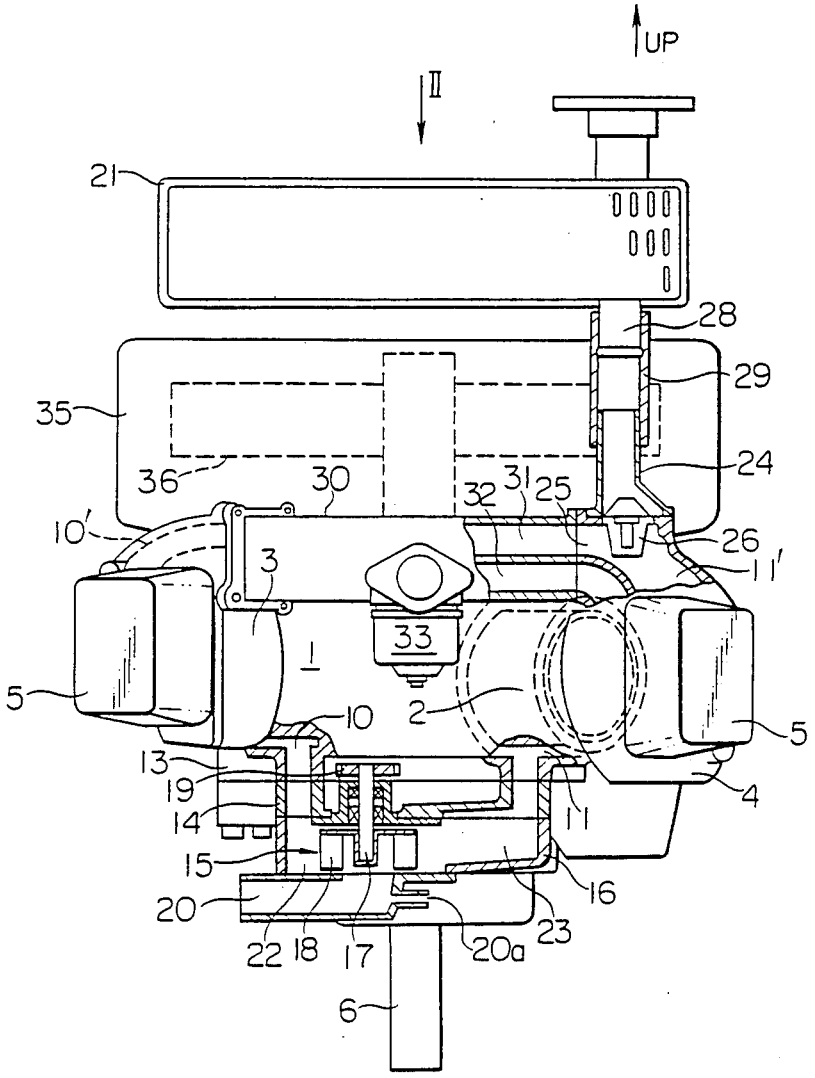
FIG. 1 is a front view, partly in cross-section, showing a V-shaped liquid-cooled engine of the vertical shaft type according to the present invention.
Figure 2:
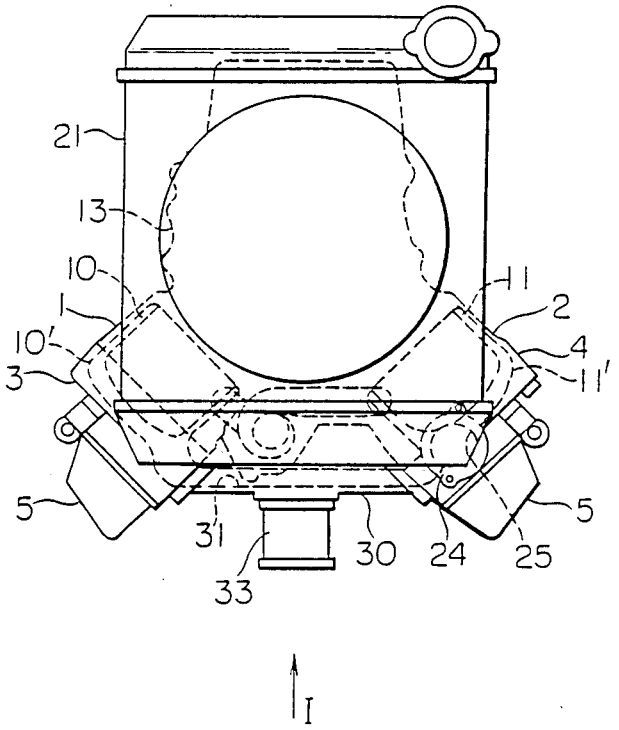
FIG. 2 is a view as seen in the direction of arrow II in FIG. 1.

FIG. 1 and 2 illustrate a cooling device applied to a V-shaped liquid-cooled engine of the vertical shaft type having two cylinders. In FIG. 2, a left side cylinder 1 and a right side cylinder 2 are arranged in the V-shape when they are viewed from the upper side and each cylinder 1, 2 is provided with a cylinder head 3, 4 secured thereto, respectively. A rocker arm cover 5 is attached to each of the cylinder heads 3, 4. Each of the set consisting of the left side cylinder 1 and the cylinder head 3 and the set consisting of the right side cylinder 2 and the cylinder head 4 is formed with cooling water jackets 10, 10' and cooling water jackets 11, 11', respectively.

In FIG. 1 showing the view partly in cross-section as seen in the direction of arrow in FIG. 2, a crank shaft 6 is arranged in the vertical position and the left side cylinder 1 is located at a higher position than that at which the right side cylinder 2 is located. A crank case 13 is formed integrally with the cylinders 1, 2, and a crank case cover 14 is fixedly secured to the lower surface of the crank case 13. A housing 16 of a water pump 15 is fixedly secured to the lower surface of the crank case cover 14, and pump vanes 18 are arranged in the housing 16. These pump vanes 18 are fixedly secured to a pump shaft 17. The pump shaft 17 is rotatably supported by the housing 16, and extends into the crank case 13, a pump driving gear 19 being integrally provided a the tip of the extended portion of the pump shaft 17. The pump driving gear 19 meshes with a gear secured to the crank shaft 6 through a cam shaft gear (not shown), for example. The water pump 15 is formed with a pair of cooling water discharge openings 22, 23 located at the left and right sides thereof, respectively, while an intake opening 20 is formed at the center of the lower surface thereof. The intake opening 20 is connected to a discharge portion of a radiator 21 located at a position above the engine through a pipe (not shown). The left and right side discharge openings 22, 23 of the water pump 15 are connected to the cooling water jackets 10, 11 of the left and right side cylinders 1, 2, respectively.

A thermostat chamber 25 is provided at the upper outlet end of the cooling water jacket 11' of the right side cylinder head 4 located lower than the other cylinder head, and a thermostat 26 is arranged in the thermostat chamber 25. A thermostat cover 24 of the upwardly projecting configuration for discharging the cooling water is provided at the upper end of the thermostat chamber 25. The thermostat chamber 25 communicates with the upper outlet end of the cooling water jacket 10' of the left side cylinder head 3 through a communicating passage 31, and the right side end of the communicating passage 31 opens into the thermostat chamber 25. The communicating passage 31 is formed within a communicating tube 30, and a suction passage 32 is also formed within the communicating tube 30 in parallel to the communicating passage 31. The suction passage 32 communicates with suction openings formed in the left and right cylinder heads 3, 4, respectively, and a carburetor 33 is connected to the suction passage 32 at the central portion thereof. The carburetor 33 is connected to an air cleaner (not shown). The thermostat chamber 25 is connected to a bypass inlet 20*a* of the water pump 15 through a narrow bypass outlet (not shown) and a pipe.

The radiator 21 is arranged in the horizontal direction above the engine and the inlet 28 formed at the lower surface of the radiator and directed downward is located directly above the upwardly directed cover 24 of the thermostat chamber 25 (vertically in a alignment with the vertical axis thereof). The cover 24 and the inlet 28 are connected to each other by a linearly extending rubber hose 29. The radiator 21 is resiliently supported by the engine through suitable brackets and resilient means, and a fan 36 is provided between the radiator 21 and the upper surface of the engine for cooling the radiator 21. A fan housing 35 is provided around the fan 36.

The cooling water drawn into the water pump 15 through the intake opening 20 from the radiator 21 by the rotation of the vanes 18 of the water pump 15 is supplied to the cooling water jackets 10, 11 of the left and right side cylinders 1, 2 through the left and right side discharge openings 22, 23, respectively, for cooling the cylinders 1, 2. The cooling water is directed to the cooling water jackets 10', 11' of the left and right side cylinder heads 3, 4 after the cooling water cools the cylinders 1, 2 to cool the cylinder heads 3, 4 and, thereafter, the cooling water reaches the upper outlet end of each of the cooling water jackets 10', 11'. The cooling water discharged from the cooling water jacket 11' of the right side cylinder head 4, located lower than the other cylinder head, is returned to the radiator 21 from the thermostat chamber 25 through the cover 24 and the rubber hose 29, while the cooling water discharged from the cooling water jacket 10' of the cylinder head 3, located higher than the other cylinder head, is returned to the radiator 21 through the communicating passage 31 and the thermostat chamber 25 and through the cover and the rubber hose 20 together with the cooling water from the cooling water jacket 11'.

The thermostat 26 senses the temperature of the cooling water in the thermostat chamber 25 and the thermostat valve is opened when the temperature of the cooling water is higher than the set temperature while it is closed when the temperature of the cooling water in the thermostat chamber 25 is lower than the set temperature. When the thermostat valve is closed, a portion of the cooling water is returned to the bypass inlet 20*a* of the water pump 15 from the bypass outlet of the thermostat chamber 25.

As described above, since the thermostat chamber is located above the cooling water jacket, no air can be trapped in the piping, and a smooth flow of the cooling air can be maintained. Further, with the left and right side cylinders arranged in a V-shape as seen from above, a radiator provided, cooling water jackets of the left and right cylinders communicating with each other at the uppermost ends of the cooling water jackets at the sides of the cylinders heads, a thermostat chamber provided at the upper most end of the cooling water jacket of the cylinder head located lower than the other cylinder head, and the end of the communicating passage opened into the thermostat chamber, the following effects can be obtained:

(1) The amount of the upward projection of the thermostat chamber and the thermostat cover can be made small, and, thus, the height of the engine is made small.

When the radiator is located at a position above the engine, the position of the radiator can be lowered without being hindered by the thermostat chamber, thereby permitting the total height of the engine to be made more compact.

(2) Since the uppermost ends of the cooling water jackets of each of the left and right cylinder heads communicate with each other and the thermostat chamber is provided at the uppermost end of the cooling jacket of the cylinder head and the end of the communicating passage is opened into the thermostat chamber, no air will be trapped in the piping of the engine even through the height of each of the cylinders of the engine is different, thereby insuring a smooth flow of the cooling water.

Further, since the radiator is located in the horizontal position above the engine and the thermostat chamber is located directly beneath the cooling water inlet opening of the radiator, the following advantages can be obtained:

(a) The piping arrangement between the radiator and the thermostat chamber is made simple, thereby making the piping operation easier.

(b) Since the water flow passage connected between the radiator and the thermostat chamber is short and linear, the flow resistance of the water flow passage is reduced, smoothing the flow of the cooling water.

(c) Since the thermostat cover is made of upwardly and downwardly facing halves, the production of the thermostat cover is made easy.

Further, as shown in the embodiment illustrated in the drawings, when the communicating passage for the cooling water and the air intake passage are integrally formed within one communicating tube, the air drawn into the engine can be heated by the warm cooling water, thereby permitting efficiency to be improved.

Now, another embodiment of the present invention will be described below with reference to FIG. 3.

A cylinder 101 is formed integrally with a crank case 102, and a crank case cover 103 is fixedly secured to the lower open end of the crank case 102. A vertical crank shaft 105 is rotatably supported by a pair of main berings 106 provided in the crank case 102 and the crank case cover 103, respectively. Oil seals 104 are provided for sealing purpose. A cylinder head 108 is fixedly secured to the right side end surface of the cylinder 101 with a gasket 115 interposed therebetween and a rocker arm cover 109 is fixedly secured to the right side end surface of the cylinder head 108. An intake valve 110 is arranged in the upper portion of the cylinder head 108 and an exhaust valve 111 is arranged in the lower portion of the cylinder head 108, an intake passage 112 is formed in the upper side of the cylinder head 108 and, an exhaust passage 113 is formed in the lower side of the cylinder head 108 and an exhaust passage 113 is formed in the lower side of the cylinder head 108 correspondingly to the arrangement of the intake valve 110 and the exhaust valve 111. The exhaust passage 113 extends downwardly and opens downwardly, while the intake passage 112 extends horizontally. Both valves, 110, 111 are horizontally supported in the cylinder head 108 through valve guides, respectively, and extend into a rocker arm chamber defined by the rocker arm cover 109. Both valves 110, 111 engage with corresponding rocker arms 14, respectively.

An annular cooling water jacket 116 is formed along the periphery of the cylinder 101, while a cooling water jacket 117 is formed in the cylinder head 108. Cooling water jacket 117 surrounds the exhaust valve 111, the exhaust passage 113, and the intake passage 112. The cooling water jacket 116 in the side of the cylinder 101 has an upper end having a cross-sectional area smaller than that of the lower end thereof. A communicating hole 118 is formed in the lower end of the head gasket 115 which communicates the lower ends of cooling water jacket 116, 117 with reach other, while an adjusting hole 124 of a small diameter is formed in the upper end of the head gasket 115 for adjusting the flow rate of the cooling water between the upper ends of cooling water jackets 116, 117.

A thermostat chamber 125 is provided at the upper side of the intake valve 110 of the cooling water jacket 117 at the cylinder head 108, and a thermostat 119 is arranged within the thermostat chamber 125. An upwardly projecting thermostat cover 120 is provided in the upper end surface of the thermostat chamber 125, and the thermostat cover 120 is connected to an inlet formed in the lower surface of a radiator 122 arranged above the thermostat cover 120 through a rubber hose 121.

A cooling water inlet 126 is formed at a position in the left lower end of the cooling water jacket 116 at the side of the cylinder 101, the position being adjacent to the crank shaft 105. A body 128 of a water pump 127 is fixedly secured to the lower surface of the crank case cover 103 adjacent to the cooling water inlet 126, and a pump cover 129 is fixedly secured to the lower surface of the body 128. A vertical pump shaft 130 is rotatably supported in the pump body 128 by bearings 131, and the upper end of the shaft 130 extends into the crank case 102. A pump driving gear 132 is fixedly secured too the tip of the extended portion of the shaft 130, while pump vanes 133 are fixedly secured to the lower end of the pump shaft 130. The pump driving gear 132 meshes with a cam shaft gear 138 which in turn meshes with a gear 139 secured to the crank shaft 105. The intake opening 134 at the lower end of the water pump 127 is connected to a cooling water outlet of the radiator 122 through a pipe and a discharge opening 135 of the water pump 127 communicates with a cooling water inlet 126 through a water passage 137 in the crank case cover 103.

During the warming up operation of the engine, the thermostat is closed and there is no substantial flow of the cooling water, but the cooling water in the cooling water jackets 116, 117 is cooled by convection taking place in the jackets. In this case, since the exhaust valve 111, which is the portion of the highest temperature, is located in the lower side of the cylinder head 108, the convection of the cooling water is enhanced and a uniform temperature distribution is achieved in the cooling water in jackets 116, 117, thereby improving the effectiveness use of the cooling water. Further, heating of air drawn in the engine immediately after the start of the engine is expedited.

When the temperature of the cooling water in the thermostat chamber 125 rises beyond a predetermined temperature, the thermostat 119 is opened. In this case, the cooling water flowing from the water pump 27 through the cooling water inlet 126 into the lower end of the cooling water jacket 116 at the side of the cylinder 101 reaches the upper end of the cooling water jacket 116 at the side of the cylinder 101, while the cooling water can flow into the lower end of the cooling water jacket 117 at the head 108 through the communicating hole 118 at the lower end of the gasket 115 between the cylinder 101 and the cylinder head 108. The cooling water entering the cooling water jacket 117 at the cylinder head 108 cools first the exhaust passage 113 and the exhaust valve 111 which are the portions having the highest temperature, and, then, flows around the intake passage 112 and the intake valve 10 located above the exhaust passage 113 and the exhaust valve 111, to cool the same and then flows into the thermostat chamber 125 located at the upper end to cool the thermostat 119. Then, the cooling water returns to the radiator 122 after flowing through the cover 120 and the hose 121.

A part of the cooling water flowing into the upper end of the cooling water jacket 116 at the side of the cylinder 101 enters the thermostat chamber 125 through the adjusting hole 125 formed in the head gasket 115.

Figure 3:
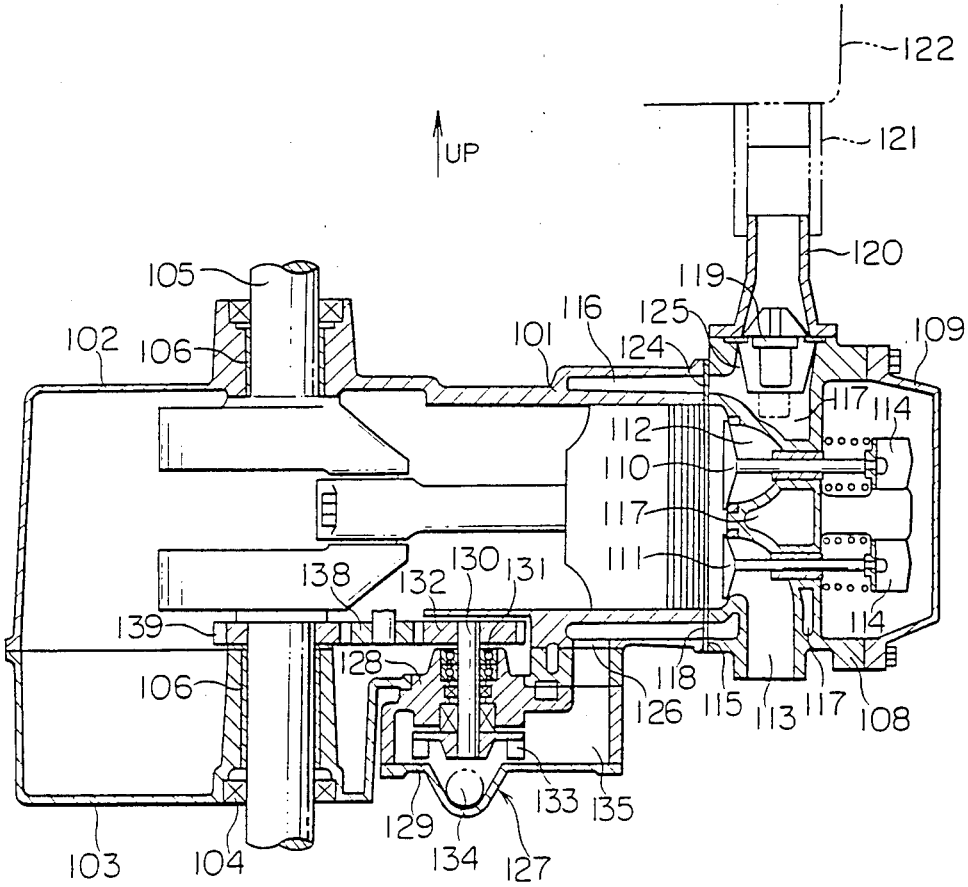
FIG. 3 is a longitudinal view showing another embodiment of the present invention.

In the embodiment shown in FIG. 3 embodying a liquid-cooled engine of the vertical shaft type provided with the water jackets in the periphery of the cylinder and the interior of the cylinder head, since the exhaust valve is arranged at a lower position while the intake valve is located at a higher position in the cylinder head, the following advantages are obtained:

(1) Since the exhaust valve which is the portion having the highest temperature is located at the lower side in the cylinder head, the convection of the cooling water in the cooling water jackets can be enhanced thereby permitting uniform temperature distribution in the cooling water jackets to be achieved to enhance the cooling effect of the cooling water even though substantially no flow of cooling water takes place while of the thermostat valve is closed during warming up of the engine.

With the above described effectiveness, the heating of air drawn into the engine during warm up can be rapidly effected and the cooling in the region around the exhaust passage can be enhanced.

(2) Since the exhaust valve is located at a position upstream of the flow of the cooling water during warm up of the engine, the exhaust passage can be arranged in either the downward direction or the horizontal direction to permit freedom of design of the exhaust system.

In the second above described embodiment, in addition to the above described construction, since the inlet of the cooling water jacket connected to the water pump is located at the lower side of the jacket at the side of the cylinder adjacent to the crank shaft and the thermostat chamber is located at the tip above the intake valve of the jacket at the side of the cylinder head, the following effects can be achieved:

(a) Since the cooling water can flow efficiently from the lower end of the cylinder adjacent to the crank shaft to the upper end of the cylinder head, the cooling water can be utilized in the most efficient manner for cooling purpose.

(b) Since the inlet of the cooling water is arranged at the lower portion of the cooling water acket, the exhaust valve is located at the upstream side of the flow of the cooling water even in the normal operating condition and the thermostat is held open, thereby improving the cooling of the exhaust valve.

In other words, the exhaust valve and the exhaust passage can be effectively cooled during both normal operating condition and warm up of the engine.

(3) Since the inlet of the cooling water is located adjacent to the crank shaft (adjacent to the pump shaft of the water pump), the driving mechanism and the water supply piping arrangement can be made simple and compact.

(4) Since the thermostat chamber is located at the upper end of the cooling water jacket at the side of the cylinder head, trapping of air can be prevented so that a superior condition of circulation of the cooling water can be maintained.

(5) Since the water pump is located at the lowest position in the cooling water circulating system, the static pressure of the cooling water adjacent to the pump vanes is made higher so that the tendency of generation of cavitation thereof can be reduced.

(6) Since the intake passage usually extends horizontally, according to another embodiment of the present invention, a large space of the water jacket provided above the intake passage can be used for arranging the thermostat chamber, so that the size of the engine can be kept compact.

(7) Since the cooling water jackets are so constructed that the cooling water flows from the portion beneath the jacket at the side of the cylinder adjacent to the crank shaft toward the tip of the jacket at the side of the cylinder head above the intake valve, the flow rate of the cooling water can be easily controlled by adjusting the size of the hole of the gasket interposed between the cylinder and the cylinder head or the size of the inlet of the cooling water jacket at the size of the cylinder head.

In the above described embodiment, the radiator has been shown as being arranged above the engine. However, the present invention can be equally applied to a liquid-cooled engine of the vertical shaft type in which the radiator is arranged at the lateral side of the engine. It is, however, more advantageous to apply the present invention to an engine in which the radiator is arranged horizontally above the engine in order to make the engine compact.

It is apparent the present invention can be applied to a liquid-cooled engine of the vertical shaft type having a plurality of cylinders such as four cylinders or eight cylinders.

Although FIG. 3 shows the cooling system which applied to an engine having intake valve and the exhaust valve arranged at the side of the cylinder head. The cooling system of the present invention can be applied equally well to an engine of the side valve type in which the exhaust valve is arranged at the side of the cylinder.

The exhaust passage 113 has been shown as extending downwardly. However, in an engine in which the exhaust valve 111 is arranged beneath the intake valve, as in the case of the present invention, it is also possible to extend the exhaust passage 113 in the horizontal direction.

What is claimed is:

1. In a liquid-cooled engine of the vertical shaft type including a radiator and a row of left and right side cylinders arranged in the V-shape as viewed from the above, wherein cooling water jackets of each of said left and right side cylinders are connected to each other at the highest end of cooling water jackets at the sides of cylinder heads of each of said cylinders through a communicating passage, while a thermostat chamber is provided at the highest end of one of said cooling water jackets in said cylinder heads which is located lower than the other cylinder head, said communicating passage being at its one end connected to said thermostat chamber.

2. Liquid-cooled engine of the vertical shaft type according to claim 1 wherein said radiator is horizontally arranged above said engine, and said thermostat chamber is positioned immediately beneath a downwardly facing cooling water inlet of said radiator.

3. Liquid-cooled engine of the vertical shaft type according to claim 1 wherein an exhaust valve in said cylinder head is positioned beneath an intake valve in said cylinder head.

4. Liquid-cooled engine of the vertical shaft type according to claim 1 wherein an exhaust valve in said cylinder head is positioned beneath an intake valve in said cylinder head, and a cooling water inlet connected to a water pump for said cooling water jacket is provided at a position beneath said water jacket at the side of said cylinder adjacent to a crank shaft of said engine, said thermostat chamber being located at the tip of said cylinder head above said intake valve in said water jacket at the said of said cylinder head.

* * * * *